United States Patent [19]

Schultz

[11] 4,146,196

[45] Mar. 27, 1979

[54] SIMPLIFIED HIGH ACCURACY GUIDANCE SYSTEM

[75] Inventor: Robert L. Schultz, Edina, Minn.

[73] Assignee: The United States of America as represented by the Secretary of the Air Force, Washington, D.C.

[21] Appl. No.: 706,048

[22] Filed: Jul. 20, 1976

[51] Int. Cl.[2] ..... F41G 3/16; F41G 3/22; F41G 7/10; F41G 9/00

[52] U.S. Cl. ..... 244/3.1; 244/3.16; 244/3.19

[58] Field of Search ..... 89/41 H, 41 EA; 244/3.11, 3.14, 3.16, 3.12, 3.1

[56] References Cited

U.S. PATENT DOCUMENTS

| | | | |
|---|---|---|---|
| 1,387,678 | 8/1921 | Anderson | 89/41 EA |
| 3,211,045 | 10/1965 | Gerhardt | 89/41 EA |
| 3,617,015 | 11/1971 | Kinder | 244/3.14 |
| 3,753,538 | 8/1973 | Marsh et al. | 244/3.12 |
| 4,020,324 | 4/1977 | Buscher et al. | 89/41 EA |
| 4,037,202 | 7/1977 | Terzian | 244/3.11 |
| 4,040,744 | 8/1977 | Schertz et al. | 244/3.16 |

*Primary Examiner*—Samuel W. Engle
*Assistant Examiner*—Thomas H. Webb
*Attorney, Agent, or Firm*—Joseph E. Rusz; Henry S. Miller

[57] ABSTRACT

A simplified guidance system for air-to-air missiles where the pilot adjusts his helmet sight to compensate for missile errors and this information is fed to a computer which computes correction data from error information, aircraft position information and missile position information, correction data is then sent via a radio link to the missile control system which changes the flight path accordingly.

2 Claims, 2 Drawing Figures

SIMPLIFIED HIGH ACCURACY GUIDANCE SYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates generally to airborne missile delivery system and in particular to a simplified system for guiding missiles once they are released from the launching platform.

Numerous systems have been proposed for the delivery and guidance of air-to-air missiles. These systems have proven to be very costly and sophisticated on the one hand, and relatively easy to counter measure on the other. For example, systems utilizing the principles of infra-red tracking and guidance may be lead astray by flares released from the tracked aircraft. Radar tracking is similarly confused by chaff and other electronic countermeasures as well as signals returned from the ground. In an effort to increase the reliability of these delivery systems, an attempt was made to allow the pilot of the weapons platform to also pilot the missile to its target via a separate control stick and television viewing system. This system, although hampered by clouds, dust and smoke functioned well, except for a rather large error or miss distance inherent in the system. The additional manual dexterity required by the pilot to fly the missile while simultaneously flying his aircraft also derogates from the total effectiveness of the system.

In any event, all cases including the simple ballastic missile risk avoidance by evasive maneuvers of the tracked aircraft.

Current air-to-air combat policy dictates that there will be visual and positive identification of a hostile aircraft before it is engaged. As a result of this most aerial combat involves close-in situations with high-q maneuvering, and rapid situation change, all taking place at generally sub-sonic speeds.

Combat under these circumstances occurs in limited air space and is terminated in extremely short time periods. This often leads to a single attack limitation for an encounter.

Existing air-to-air delivery and guidance missile systems are not designed for this environment. The weapon envelopes under the close-in high-g target encounter are limited, due to missile reaction time and acceleration limitations.

The disadvantages of the prior art have been markedly improved by a new combination of apparatus into the system of this invention which has proven highly effective within the above mentioned criteria.

SUMMARY OF THE INVENTION

The invention utilizes a helmet mounted sight to direct an inertially guided missile along the line of sight from the pilot to the target. The helmet sight provides direct coupling into the optical environment which is the critical element of short-range air-to-air fighter engagements.

In general, the pilot aims his helmet-mounted sight at the target and establishes a line of sight toward the target. When the pilot has established an acceptable condition within the weapon system launch envelope by maneuvering of the aircraft and tracking of the target, he launches a missile. The missile is command-guided to the line of sight of the helmet-mounted sight on the basis of navigation computations. The position of the missile relative to the helmet sight (line of sight) is derived by an aircraft computer from information transmitted from an inertial reference package in both the missile and the aircraft.

The operational sequence during a missile firing event involves initially the guidance and missile control system, which quickly brings the missile into visual juxtaposition with the target except for an observable angular error between the missile and the target. This error is caused by aircraft and missile navigational computation errors, the helmet sight error, approximations in the guidance equations, and limitations in missile performance. The cumulative total of these errors in the ordinary case is unacceptable for operational purposes if it is not removed.

The error can be removed by using the pilot as a seeker. In this process, the pilot observes the missile-target separation and moves the helmet sight to eliminate the error. Since the missile is guided to the line-of-sight, the pilot performs a two-axis stable tracking task. Sufficient time is available to detect the error; move the helmet sight line-of-sight, and eliminate the error through corrective signals to the missile flight control system. The pilot thus provides terminal guidance which permits a simpler missile and a guidance and control system which can be designed around relaxed performance requirements for hardware.

It is therefore an object of the invention to provide a new and improved simplified high accuracy guidance system.

It is another object of the invention to provide a new and improved simplified high accuracy guidance system that is particularly adaptable to air borne missile systems.

It is a further object of this invention to provide a new and improved simplified high accuracy guidance system that is more reliable than similar systems heretofore known.

It is still another object of the invention to provide a new and improved simplified high accuracy guidance system that is less costly than other similar known systems.

It is still a further object of the invention to provide a new and improved simplified high accuracy guidance system for airborne missile systems that is relatively invulnerable to counter measures.

It is another object of the invention to provide a new and improved simplified high accuracy guidance system for airborne missile systems that allows for high maneuverability of the missile.

It is another object of the invention to provide a new and improved simplified high accuracy guidance system for airborne missile systems that permits the pilot to exercise terminal control over the in-flight missile.

It is another object of the invention to provide a new and improved simplified high accuracy guidance system for airborne missile systems which is economical to produce and utilizes conventional, currently available components that lend themselves to standard mass production manufacturing techniques.

These and other advantages, features and objects of the invention will become more apparent from the following description taken in connection with the illustrative embodiment in the accompanying drawings.

DESCRIPTION OF THE PREFERRED EMBODIMENT

Figure 1:
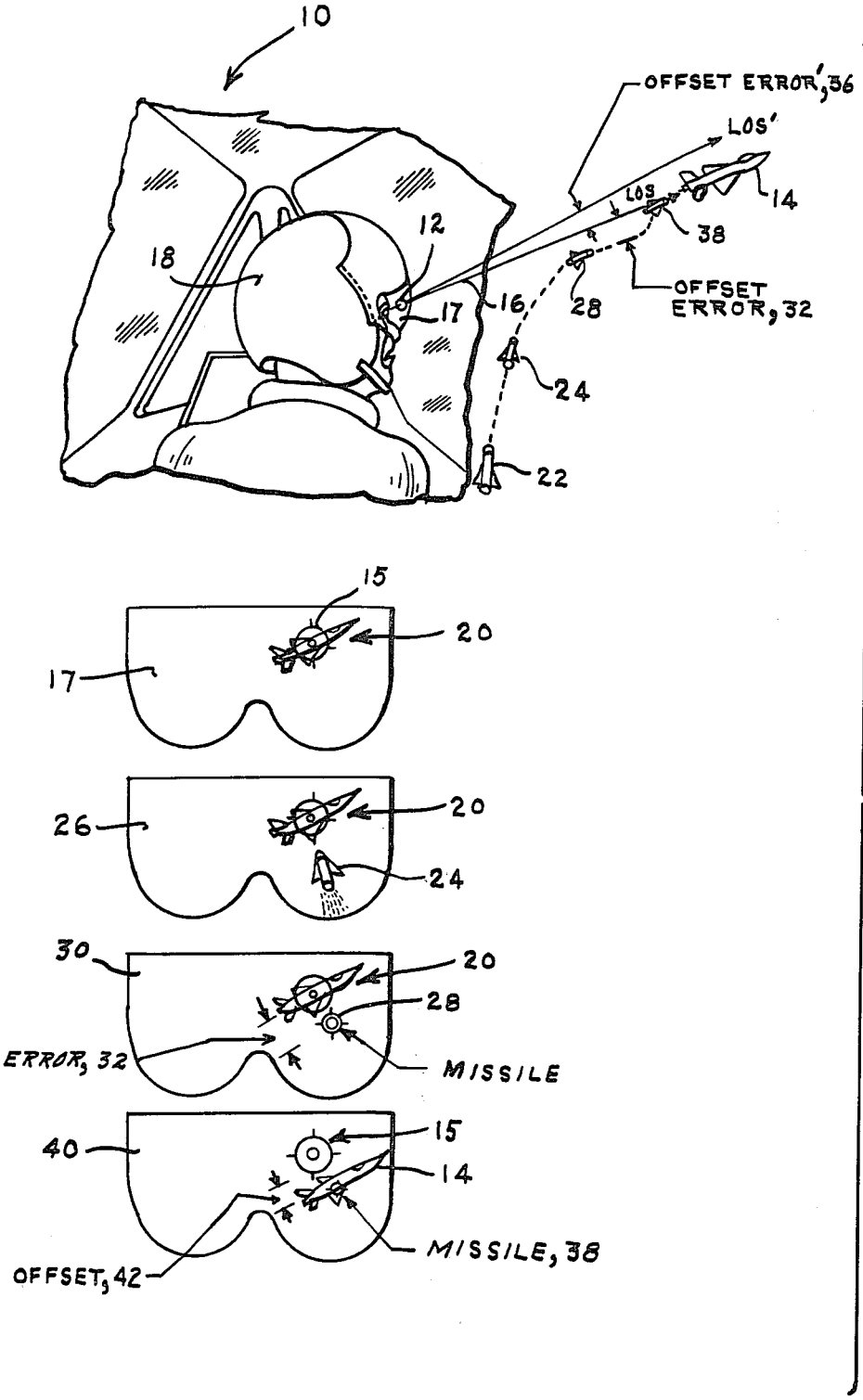
FIG. 1 is a schematic representation of the operation of the invention.

Referring now to FIG. 1, there is shown the system in operation. The pilot in his aircraft shown generally at 10 turns his head and aims his helmet sight 12 at the target 14. Through the reticle (15) in the sunshield 17 of his helmet 18 the pilot observes the pattern shown generally at 20. The pilot then manipulates the appropriate switches to activate the system and establishes a line-of-sight 16 to the target. The aircraft must be maneuvered within limits to a certain relative relationship with the target. When this is accomplished, the pilot launches a missile 22.

The launched missile is command-guided to the line-of-sight 16 on the basis of navigation computations. The missile shown at 24 moves away from the aircraft toward the target. The pilot's view is shown through his sunshield 26. The guidance system brings the missile on to the line of sight toward the target except for an offset error. The missile is now shown at 28 and through the sunshield 30 the pilot is able to distinguish the error 32. The error may be caused by any force effecting the launching platform, the missile or the target.

The pilot, observing the error then moves his helmet and hence the reticle, moving the line-of-sight to 34 and the offset error to 36. Since the missile is guided to the line-of-sight it will change course and terminate its flight on target which is shown by missile 38. The pilot looking through his sunsheild 40 offsets the reticle 15, an amount 42 equal to the error 32, thereby causing the missile to reach the target 14.

Figure 2:
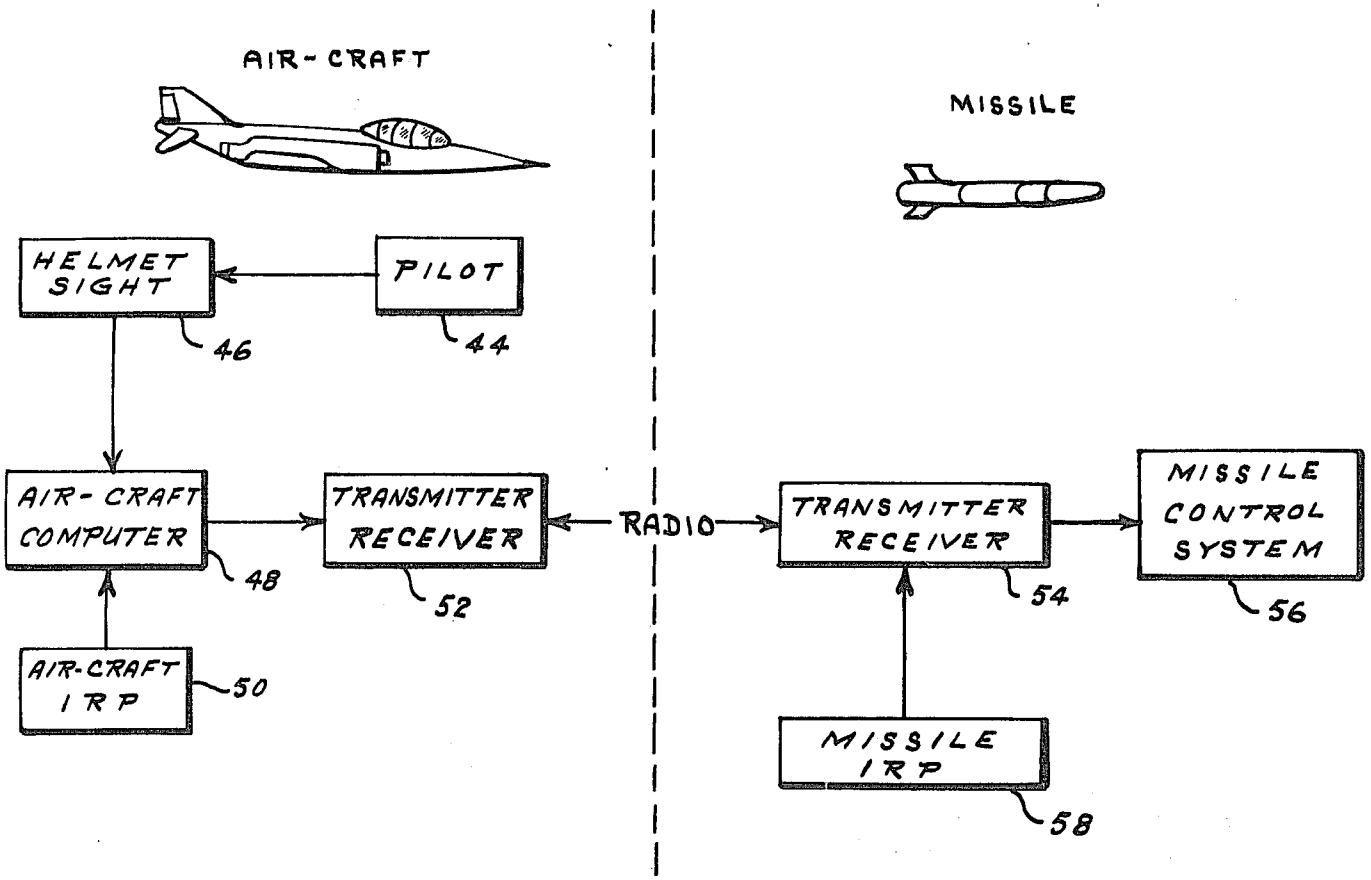
FIG. 2 is a block diagram of the system of the invention.

FIG. 2 discloses in black diagram form how the system functions. The pilot 44 wearing the helmet sight 46 moves his head and hence, the sight to establish a line-of-sight to the target. The helmet sight is connected to the aircraft computer 48 which accepts as input, two-axis direction information from the helmet sight. Additionally, the computer receives navigational input from the aircraft inertial reference package 50. The location and direction data determined in the computer 48 is sent via the radio transmitter-receiver 52 to the missile radio transmitter-receiver 54.

This information is directed into the missile control system 56 which appropriately changes the course of the missile according to the line-of-sight determined by the pilot.

The missile is provided with an inertial reference package 52 which sends position information back to the aircraft computer 48 via radio link transmitters and receivers 52 and 54. Corrective data is constantly updated based upon information from the helmet sight, aircraft position and missile position.

Although the invention has been described with reference to a particular embodiment, it will be understood to those skilled in the art that the invention is capable of a variety of alternative embodiments within the spirit and scope of the appended claims.

What is claimed is:

1. A simplified high accuracy guidance system comprising:

an aircraft missile launching platform including a pilot controlled protective helmet, at least one missile adapted to be launched from said platform; reticle sighting means located in said helmet for the pilot to observe a target; computer means connected to the helmet sighting means for establishing a line of sight to the target; an internal reference package means connected to said computer means for determining the position of the launching platform; radio frequency transmitter and receiver means for communicating changing line of sight data to the missile; a missile flight control system including a radio frequency transmitter and receiver means for changing the flight path of the launched missile based upon data received; internal reference means for determining the position of the missile relative to the target and means for communicating position information to the said computer means.

2. A method for guiding air-to-air missiles using a helmet mounted sight including: launching a missile from an airborne piloted launching platform; observing the target through the helmet mounted sight; observing the missile on the line-of-sight path to the target; moving the helmet and line-of-sight path away from the target, an amount sufficient to compensate for errors whereby the missile will strike the target.

* * * * *